US008678197B2

(12) United States Patent
Koike et al.

(10) Patent No.: US 8,678,197 B2
(45) Date of Patent: Mar. 25, 2014

(54) POWDER REMOVING DEVICE FOR TABLET FEEDER

(75) Inventors: Naoki Koike, Toyonaka (JP); Mitsuhiro Mitani, Toyonaka (JP)

(73) Assignee: Yuyama Mfg. Co., Ltd., Toyonaka-shi, Osaka (JP)

( * ) Notice: Subject to any disclaimer, the term of this patent is extended or adjusted under 35 U.S.C. 154(b) by 148 days.

(21) Appl. No.: 13/203,944

(22) PCT Filed: Mar. 1, 2010

(86) PCT No.: PCT/JP2010/053198

§ 371 (c)(1),
(2), (4) Date: Aug. 30, 2011

(87) PCT Pub. No.: WO2010/101098

PCT Pub. Date: Sep. 10, 2010

(65) Prior Publication Data

US 2011/0309101 A1 Dec. 22, 2011

(30) Foreign Application Priority Data

Mar. 5, 2009 (JP) ..... 2009-051850
Jul. 29, 2009 (JP) ..... 2009-175990

(51) Int. Cl.
*B07B 1/28* (2006.01)

(52) U.S. Cl.
USPC ..... 209/314; 209/320

(58) Field of Classification Search
USPC ..... 209/311, 314, 320, 364, 370
See application file for complete search history.

(56) References Cited

U.S. PATENT DOCUMENTS 675,057 A * 5/1901 Edison ..... 209/356
940,212 A * 11/1909 Stone ..... 209/356
2,203,152 A * 6/1940 Johnson ..... 209/356

(Continued)

FOREIGN PATENT DOCUMENTS

JP 53-39870 4/1978
JP 58-131942 9/1983

(Continued)

OTHER PUBLICATIONS

Office Action corresponding to JP2011-502736, dated Dec. 18, 2012.

(Continued)

*Primary Examiner* — Joseph C Rodriguez
(74) *Attorney, Agent, or Firm* — Lowe, Hauptman & Ham, LLP

(57) ABSTRACT

Powder (b) cut and attached to tablet pieces (T1, T2) can be removed smoothly. A tablet dividing feeder (A1) cuts and divides a tablet (T) in a receiving pocket into two halves with a fixed blade as a rotor rotates. Powder removing plates (64*a*, 64*b*, 66) are installed in a tablet supplying passage (14) of the feeder. The powder removing plate (64*b*) is vibrated by a vibration motor (71) to peel the powder (b) attached to the tablet on the powder removing plate and drop the powder (b) from a slit (a). The peeling operation is performed by temporarily leaving the tablet pieces (T1, T2) between the powder removing plates (64*a*, 64*b*). The powder removing plate (64*b*) is fluctuated by a plunger, and the tablet pieces may be left and dropped due to the fluctuation. The tablet piece drops along the powder removing plate (66), and the attached powder is peeled to be guided to a packaging process through a supply opening (90).

7 Claims, 18 Drawing Sheets

(56) References Cited

U.S. PATENT DOCUMENTS

| | | | | |
|---|---|---|---|---|
| 2,617,137 | A * | 11/1952 | Bodnar | 15/308 |
| 5,098,557 | A * | 3/1992 | Hirschler et al. | 209/29 |
| 5,469,971 | A * | 11/1995 | Chilton et al. | 209/235 |
| 5,504,972 | A * | 4/1996 | Tada et al. | 15/404 |
| 7,309,201 | B2 * | 12/2007 | McNaughton et al. | 414/160 |
| 2007/0154290 | A1 * | 7/2007 | McNaughton et al. | 414/160 |
| 2012/0324828 | A1 * | 12/2012 | Yasunaga et al. | 53/111 R |

FOREIGN PATENT DOCUMENTS

| | | | |
|---|---|---|---|
| JP | 62-079888 | A | 4/1987 |
| JP | 2-29257 | | 1/1990 |
| JP | 7-136591 | | 5/1995 |
| JP | 7-236998 | A | 9/1995 |
| JP | 11-226089 | | 8/1999 |
| JP | 2003-63503 | | 3/2003 |
| JP | 2005-59903 | | 3/2005 |
| JP | 2006-306430 | | 11/2006 |
| JP | 2007-135982 | | 6/2007 |
| JP | 2008-162609 | | 7/2008 |
| JP | 2008-200234 | | 9/2008 |
| WO | 2010/032418 | | 3/2010 |

OTHER PUBLICATIONS

International Search Report mailed Jun. 1, 2010 for PCT application No. PCT/JP2010/053198.

* cited by examiner (a)

(b)

POWDER REMOVING DEVICE FOR TABLET FEEDER

CROSS REFERENCE TO RELATED APPLICATION

This application claims the priority of Japanese Patent Application No. 2009-051850, filed on Mar. 5, 2009, and Japanese Patent Application No. 2009-175990, filed on Jul. 29, 2009 in the JPO (Japan Patent Office), the disclosure of which is incorporated herein in their entirety by reference. Further, this application is the National Phase application of International Application No. PCT/JP2010/053198, filed Mar. 1, 2010 which designates the United States and was published in Japanese. Each of these applications is hereby incorporated by reference in their entirety into the present application.

TECHNICAL FIELD

The present invention relates to a powder removing device for a tablet feeder which is used to supply tablets to be prepared based on a prescription from a hospital, a medical office, a pharmacy, etc.

BACKGROUND ART

Medicine supplying apparatuses used to prepare tablets based on a prescription include Japanese Patent Application Publication No. 2003-63503 (see FIG. 1 thereof and FIG. 23 of the subject application) where a plurality of tablet feeders each having a rotor therein are installed at steps along an inner circumference of a tablet accommodating case to selectively supply tablets from the tablet feeders and pack the tablets, and Japanese Patent Application Publication No. 2008-162609 (see FIG. 6 thereof) where a plurality of tablet feeders are disposed to have a tray-like shape and tablets are selectively supplied from the tablet feeders based on a prescription like in Japanese Patent Application Publication No. 2003-63503.

An example of such a tablet feeder is Japanese Patent Application Publication No. 2005-59903 where a rotor is received in a vessel for receiving a plurality of tablets, a plurality of receiving grooves (recessed portions) for receiving tablets are formed at a regular interval along a circumference of a side surface of the rotor, and the tablets drop one by one through a discharge opening from the receiving grooves if the receiving grooves face the discharge opening as the rotor rotates so that the tablets in the vessel can be moved in a rotational direction while being received in the receiving grooves.

Meanwhile, there is an occasion where a tablet corresponding to a dose is a half of the original tablet according to a prescription, in which case the tablet divided into two halves in advance needs to be supplied while being set in a table supplying apparatus.

Examples of such a tablet divider are Japanese Patent Application Publication No. H2-29257 (see FIG. 1) where a tablet is interposed between a pair of belt conveyors to be moved downward and is divided into two halves by a rotary cutter while it is being moved and Japanese Patent Application Publication No. H11-226089 (see FIG. 6) where a tablet is moved into a tube, is stopped by a shutter while being moved, is divided into two halves by a cutter so that the tablet piece corresponding to the lower half drops, the tablet piece corresponding to the upper half remains on the cutter, and the tablet piece corresponding to the upper half is dropped by retrieving the cutter.

When a tablet is fed by such a tablet feeder, some parts of the tablet may be lost or separated into pieces by friction, causing generation of powder. In particular, in the feeder for dividing a tablet, powder is produced when the tablet is divided. If the powder is introduced into a pack for a tablet, this may be unpleasant for some takers of the medicine.

For this reason, technology for raking dust with a brush in the middle of a supply passage from a rotor of a tablet feeder and discharging the raked dust through a discharge opening has been suggested (see claim 3, Paragraph 0024, and FIG. 2 of Japanese Patent Application Publication No. 2006-306430).

Further, technology for removing dust attached to a tablet through suctioning or air injection in a tablet manufacturing or inspecting process has been suggested (see the abstracts of Japanese Patent Application Publication Nos. 2008-200234 and 2007-135982).

Patent Document 1: Japanese Laid-open Patent Publication No. 2003-63503

Patent Document 2: Japanese Laid-open Patent Publication No. 2008-162609

Patent Document 3: Japanese Laid-open Patent Publication No. 2005-59903

Patent Document 4: Japanese Laid-open Patent Publication No. H2-29257

Patent Document 5: Japanese Laid-open Patent Publication No. H11-226098

Patent Document 6: Japanese Laid-open Patent Publication No. 2006-306430

Patent Document 7: Japanese Laid-open Patent Publication No. 2008-200234

Patent Document 8: Japanese Laid-open Patent Publication No. 2007-135982

DISCLOSURE

Technical Object of the Invention

In the conventional tablet divider, since a cutting blade is formed only on one side for a certain medicine, such as a sugarcoated tablet whose surface is coated, the tablet may be moved on the cutting blade and thus the coating layer may not be cut with certainty to be discharged as it is. Thus, as illustrated in FIG. 24, splinters may be created on a coating layer and be discharged (see FIG. 24A), the coating layer remains as splinters e in the halves T1 and T2, so that the halves T1 and T2 are connected to each other through the splinters e, and left on the cutting blade not to be discharged (see FIG. 24B), or the halves T1 and T2 are discharged while being connected to each other. In the drawings, the reference numeral 3 indicates a cutting blade.

If some of the halves have splinters, the sizes of the divided halves T1 and T2 become different, causing a problem in determining a dose. Further, if the tablet pieces T1 and T2 are connected to each other, they need to be separated by hand.

Furthermore, if splinters e are produced, powder such as cut powder is apt to be in a greater quantity than in a case where a tablet is divided into two halves T1 and T2 with certainty.

Since the former tablet divider divides a tablet from top to bottom, the tablet is divided and split into right and left pieces, and then the two tablet pieces drop. For this reason, the two tablet pieces need to be separated by hand, or if the number of prescribed tablets is odd, one tablet piece becomes unnecessary and needs to be removed by hand.

Meanwhile, since the latter tablet divider can drop the upper and lower tablet pieces individually, they can be prevented from falling down by leaving a tablet piece corresponding to the upper half on a cutter, making it possible to wait until a later time when the piece is required. That is, there occurs no inconvenience of removing one tablet piece as in the former tablet divider.

However, the cutter needs to be moved, making the operation complex.

Moreover, since the dust attached to a tablet does not need to be peeled off (removed), the attached powder is supplied from a tablet feeder together with a tablet. That is, the attached dust cannot be prevented from being introduced into a tablet pack.

Although it may be considered that powder attached to a tablet may be removed by installing a means for suctioning or air injection in a tablet passage of a tablet feeder, the suctioning/injecting mechanism becomes large-sized and it is not easy to process the removed dust. That is, it is difficult to employ the means in a small-sized tablet feeder.

Accordingly, the present invention has been made to solve the above-mentioned problems occurring in the prior art, and the first object of the present invention is to provide a simple structure by which powder (dust) attached to a tablet can be removed.

It is the second object of the present invention to prevent a structure by which splinters are prevented from being generated due to a coating material and cut and split tablets (tablet pieces) are prevented from being discharged when they are connected through splinters.

Technical Solution

In order to accomplish the first object, there is provided a powder removing plate having pores or slits having a size which does not allow a tablet to pass by a tablet dropping surface of a tablet discharging passage (tablet passage) of a tablet feeder.

If a tablet rolls and drops along a powder removing plate, the attached powder is peeled when the tablet contacts a periphery of a hole or a slit of the powder removing plate or is peeled by a difference of falling speeds due to a difference of weights, so it drops to the lower side of the powder removing plate through the hole or slit. That is, the powder attached to the tablet is removed while passing through the tablet passage.

The powder which has dropped through the powder removing plate gathers in a powder collecting box installed on the lower side of the powder removing plate.

A powder removing device for a tablet feeder in which tablet passages are continuously installed in a discharge opening of the tablet feeder for supplying tablets, in turn, from a tablet accommodating case to the discharge opening, the powder removing device including: powder removing plates having pores or slits whose sizes do not allow the tablet to pass therethrough and interposed to cross the tablet passages, wherein the tablet is discharged through the discharge opening to reach the powder removing plates, and drop along the powder removing plates to reach a supply opening of the tablet passage may be employed.

In the above configuration, if a plurality of powder removing plates is installed in zigzags toward the lower side of the tablet passage, the powder removing passage can be made long.

Further, if a vibration means is installed in the powder removing plate, its removal efficiency can be enhanced. When there exist a plurality of powder removing plates, the vibration means may be installed in all or some of them. When the vibration means is installed in some of the powder removing plates, if it is installed at the uppermost step, vibration is generated with a large amount of powder, power removal efficiency can be increased. A well-known means such as a vibration motor can be used as the vibration means. The vibration means may be directly installed in the powder removing plate, or may be indirectly installed in a case to which the powder removing plate is attached. For example, any position will be good only if the powder removing plate can be vibrated.

The powder removing plates where the vibration means are installed are installed to close the tablet passage and cross the tablet passage downward and the powder removing plates are movably installed to open the tablet passage in a closed state, and a movement means movable from a closed state to an opened state or from an opened state to a closed state is installed in the powder removing plate, whereby the tablet can be temporarily left on the powder removing plate to be vibrated, making it possible to enhance powder removal efficiency.

The pair of powder removing plates closing the tablet passage and having pores or slits of a predetermined size which do not allow the tablet to pass therethrough are disposed to form an inverted triangle, lower ends of the powder removing plates have an aperture through which the tablet does not drop or contact each other, the vibration means are installed on at least one of the powder removing plates, at least one of the powder removing plates is moved to widen the aperture between the lower ends of the powder removing plates to allow the tablet to drop, and a movement means is installed in the moving powder removing plate, whereby the tablet can also be temporarily left on the powder removing plate to be vibrated, making it possible to enhance powder removal efficiency. Then, the powder removing plate without any vibration means may be a plate having no pores or slits, i.e. a plate through which tablet powder cannot pass.

The time interval for which the tablet is left may be properly set by experiments and the like, considering a degree by which attached powder can be removed.

The moving structure of the power removing plate can be realized using various types. For example, the powder removing plate is installed so as to be rotatable at an upper end thereof in a case forming the tablet passage such that the tablet is allowed to drop by rotating the powder removing plate by means of the movement means. Then, the rotation means may be a well-known means such as a solenoid actuator or a motor.

In more detail, a rotary plate may be installed in such a manner that the rotary plate, whose upper end contacts a lower end of the powder removing plate, is inclined downward opposite to a direction of the powder removing plate so as to be lower side of the powder removing plate and the rotary plate is rotated by the rotation means whereby the tablet is prevented from dropping or is allowed to be dropped.

The powder removing device may be installed in various tablet feeders. When the powder removing device is installed in a tablet dividing feeder for cutting, dividing, and supplying a tablet, since it is important to remove cut powder, it may preferably be installed in the tablet dividing feeder.

According to the configuration of the tablet dividing feeder, a tablet is moved in one direction, for example, in a horizontal direction, a fixed blade is located in the middle to cut and divide the tablet when the tablet is moved, and the lower tablet piece is discharged after it is divided by the fixed blade and the upper tablet piece is moved from the fixed blade to a support piece connected to the fixed blade. The upper tablet piece may be discharged from the support piece through further movement thereof.

Then, if the fixed blade for cutting is formed only on one side, as illustrated in FIG. 24A, the fixed blade 3 does not necessarily pass through the divided tablet T (half pieces T1 and T2), the upper and lower tablet pieces T1 and T2 pull together, causing splinters e. However, if the fixed blade for cutting is formed at both sides, after a tablet T is sent to the inner side of the two opposite blade tips and a cutting operation is performed to the tablet T by one blade tip, a cutting operation is performed by the other blade tip. Further, a cutting operation is performed by both blade tips, and the divided tablet passes the cutting blade from a point where both the blade tips converge and move further (see FIG. 20). Thus, the split tablet pieces T1 and T2 are necessarily divided by the fixed blade, whereby even a tablet T whose surface is coated such as a sugarcoated tablet can be cut to the coating layer with certainty, making it difficult to generate splinters e and dividing the tablet with the fixed blade with certainty. As splinters e disappear and the cutting operation can be smoothly performed, generation of cut powder is restricted, helping achieve the first object and achieving the second object at the same time.

The tablet cutting blade for a tablet dividing feeder showing the operation has a notch whose end becomes gradually narrower as it goes from a periphery facing the tablet moving relatively toward the relative moving direction, in which case facing peripheries of the notch form a blade tip and a tip end in the direction in which both the blade tips become narrower may converge and disappear.

The cutting blade may be one (see the upper blade indicated by the reference numeral 33*a* of FIG. 21), but two overlapping cutting blades may be formed such that a blade tip of the facing peripheries of one cutting blade is formed by a blade tip of the cutting blade and a blade tip of the facing peripheries of the other cutting blade is formed by a blade tip of the other cutting blade, the notch being formed between both the blade tips when the overlapped state is viewed from the top (see FIG. 21).

Advantageous Effects

As described-above, since a powder removing device is installed a tablet discharging passage, tablets from which attaching powder is removed maximally are supplied from a tablet feeder.

Further, since a tablet is divided (cut) by both cutting blades, it can be smoothly cut and an amount of generated powder is reduced, making it possible to prevent connection of divided tablets (tablet pieces) through splinters e with certainty.

DESCRIPTION OF DRAWINGS

FIG. 21 illustrates another example of a fixed blade, wherein FIG. 12A is an exploded perspective view, FIG. 12B is a plan view, and FIG. 2C is a perspective view;

FIG. 22 illustrates another example of a tablet powder removing device, wherein FIG. 22A is a partially exploded perspective view and FIG. 22B is a perspective view where a cover is put on a case;

BEST MODES FOR CARRYING OUT THE INVENTION

Figure 23:
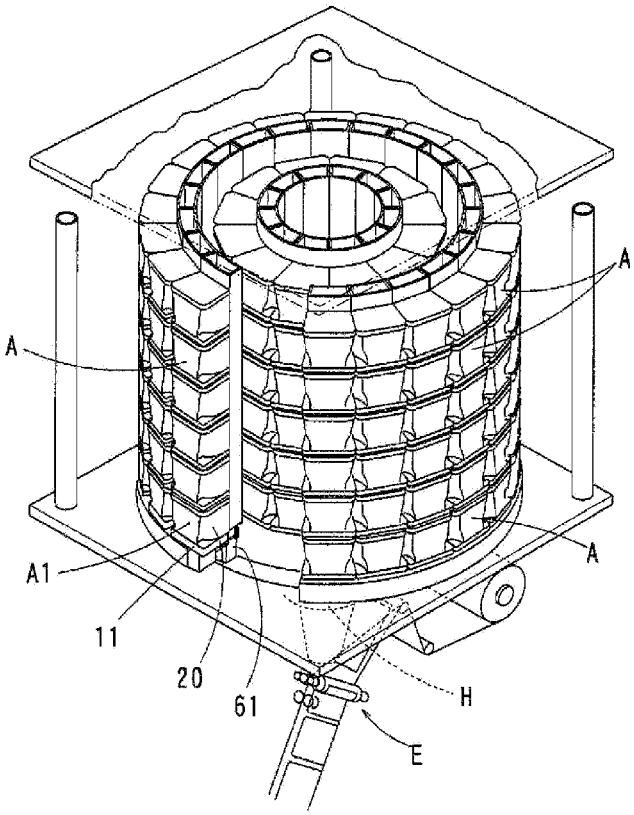
FIG. 23 is a partially removed perspective view illustrating an example of a medicine supplying unit.

The embodiment of the present invention is applied to a medicine supplying unit of FIG. 23, e.g. a tablet dedicated supplying unit where tablet feeders A each having a rotor therein are installed at a plurality of steps disposed at an entire circumference of a tablet accommodating case within the tablet accommodating case, in which case at least one of the tablet feeders A is exchanged with another tablet dividing feeder A1, or tablet dividing feeders A1 are installed separately. In the former case, a same type of motor base is used for motor bases (mounts) 11 of a tablet feeder A and a tablet dividing feeder A1 if possible. Generally, the latter case is desirable since a strong motor is necessary for cutting a tablet and a transmitting pinion needs to be formed of a strong material like a metal. In the latter case, a motor base of a tablet dividing feeder A1 is dedicated separately.

In the medicine supplying unit, after necessary tablets are supplied from a receiving portion of a tablet feeder A and collected in a hopper H based on a prescription, the tablets may be fed to a medicine packaging unit E to be packaged. As an alternative, in a manual distribution unit (not shown), after tablets which have not existed in the receiving portion of the tablet feeder A or A1 are fed to the hopper H or tablets (tablet pieces) T (T1 or T2) are fed to the hopper H regardless of the existence of tablets in the receiving portion of the tablet feeder A or A1, they are fed to the medicine packaging unit E to be packaged (see FIG. 1 of Japanese Patent Application Publication No. 2003-63503).

The tablet dividing feeder A1 (tablet feeder A) has a configuration illustrated in FIGS. 1 to 20, wherein the motor base includes a synthetic resin mount 11 to which a tablet cassette (container) 20 of the tablet dividing feeder A1 is detachably mounted, and is fixed to a body of a medicine supplying (loading) unit to be installed at a step of a shelf (see FIG. 23). A guide 12, an inner surface of which guides a U-shaped support 22 of the tablet cassette 20, is installed on an upper surface of an attaching surface 11*a* of the mount 11 (see FIGS. 1 to 4).

A motor (not shown) driven and controlled based on a control signal from a control unit (not shown) is accommodated in the mount 11. A rotary shaft of the motor protrudes at a corner of the tablet cassette attaching surface 11*a* of the mount 11 and a pinion 13 is fixedly attached to the rotary shaft of the motor.

Figure 1:
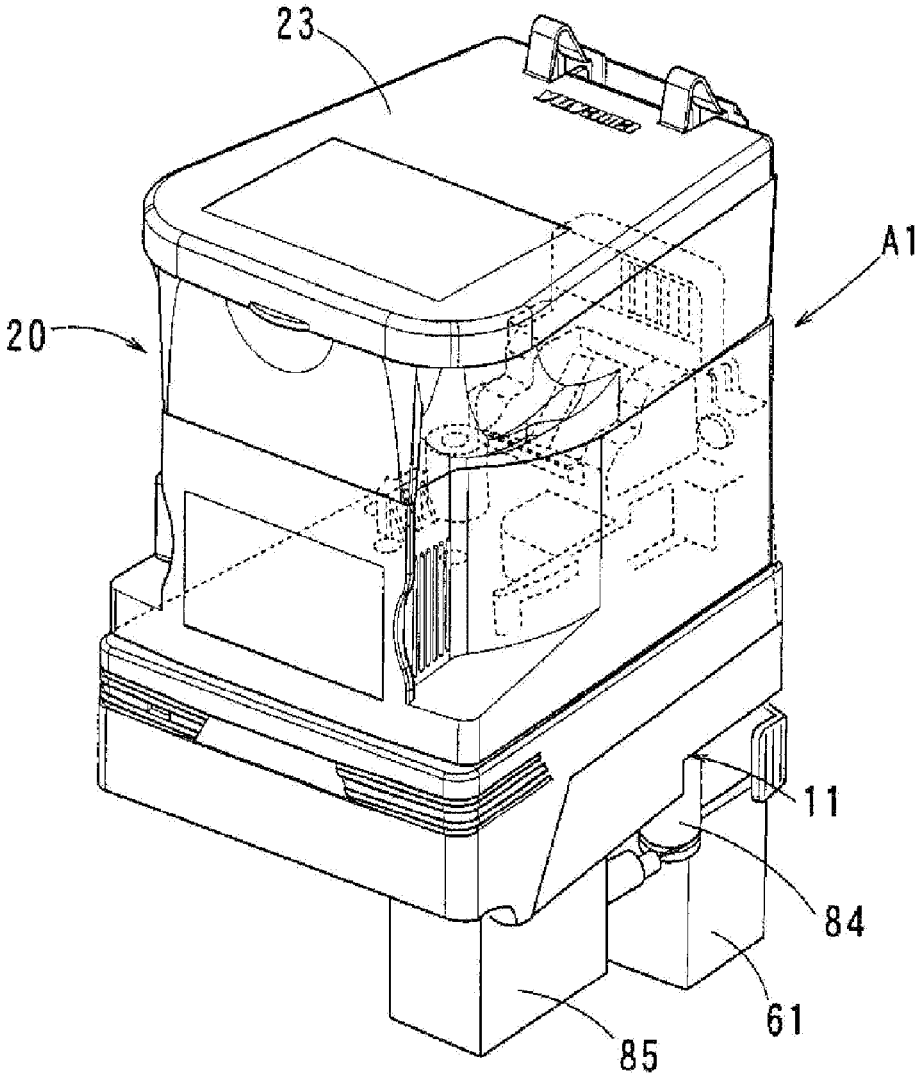
FIG. 1 is a perspective view illustrating a tablet feeder according to an embodiment of the present invention.

A second downwardly inclined passage (tablet passage) 14 communicated (continuous) with a discharge opening 27 of the tablet cassette 20 is formed in the mount 11 and a sensor 18 for detecting tablets (tablet pieces) T (T1 and T2) passing through the second passage 14 is installed on opposite side surfaces of the second passage 14, which is continuous with a tablet passage communicated with the hopper H of a medicine distributing unit (see Paragraph 0047 and FIG. 1 of Japanese Patent Application Publication No. 2005-59903 for more details)

Locking holes (claw) 17 by which a pair of claw members 29 (see FIGS. 2 and 3) on a lower surface of the tablet cassette 20 are locked are formed at opposite sides of a front wall of the second passage 14 of the mount 11, so if the tablet cassette 20 is set in the mount 11, a claw 29" is inserted into the locking hole 17, and the tablet cassette 20 and the mount 11 can be integrally connected. If a boss (button) 29' protruding to a side surface of the tablet cassette 20 of the claw member 29 is pushed, the claw 29" is withdrawn (released) from the locking hole 17 and the tablet cassette 20 can be separated from the mount 11.

A magnetic sensor is installed in the middle of the second passage 14, in which case if a fixed blade 33 which will be described later is damaged and its fragments are supplied together with a medicine, the metal fragments can be detected or can be attached to the magnet installed in the passage 14.

Figure 2:
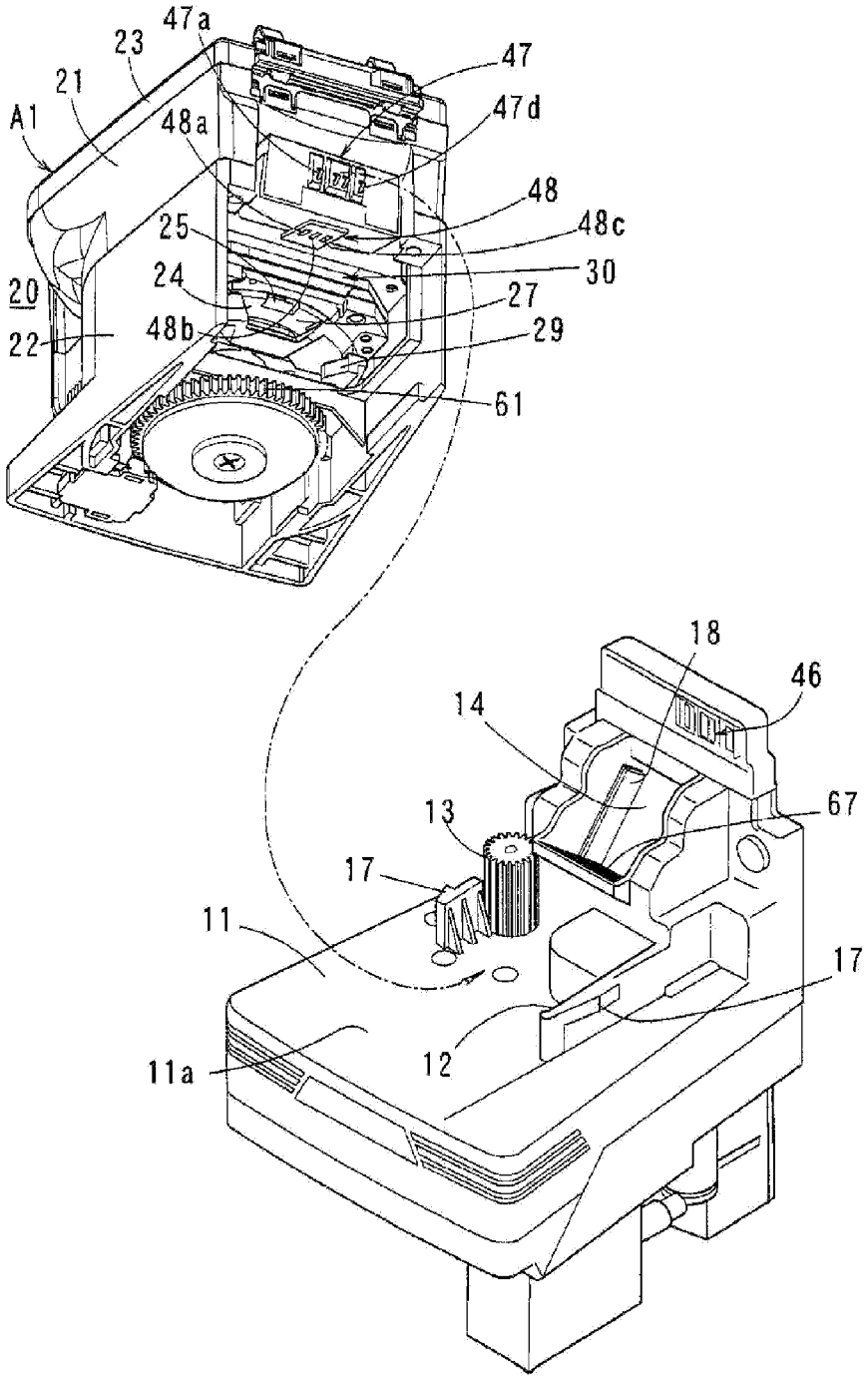
FIG. 2 is a perspective view separately illustrating a tablet cassette and its mount according to the embodiment of the present invention.
Figure 3:
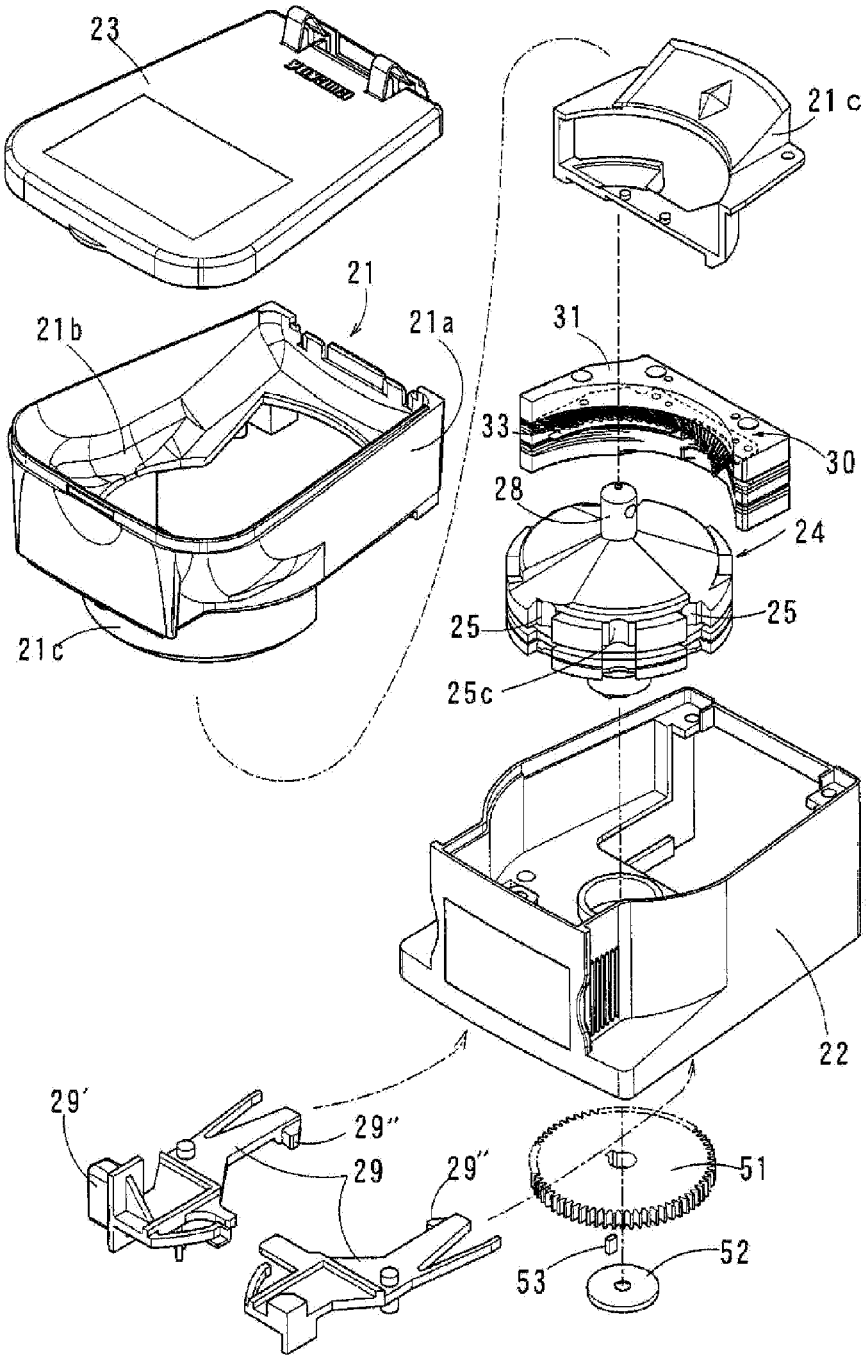
FIG. 3 is an exploded perspective view of the tablet cassette of FIG. 2.
Figure 4:
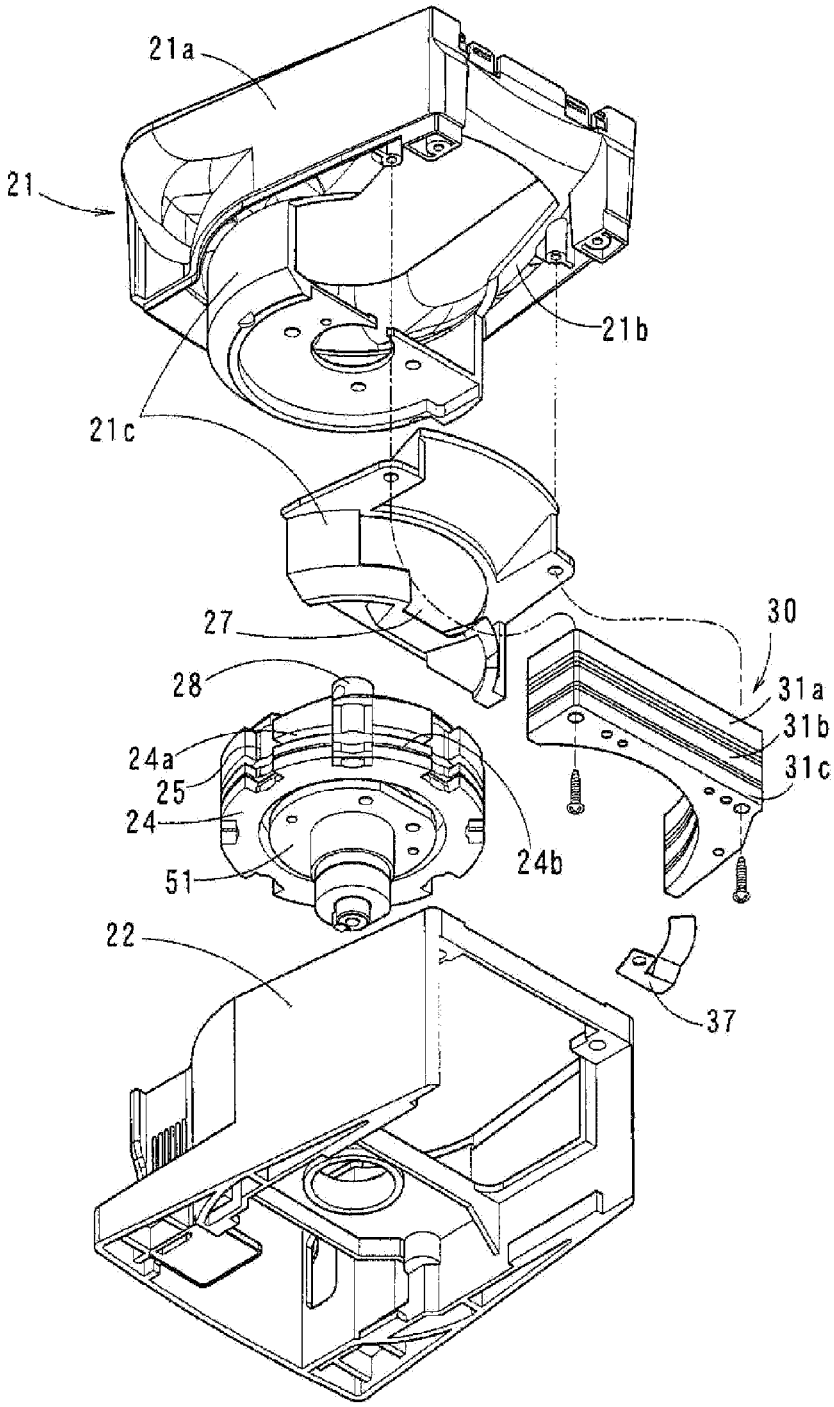
FIG. 4 is an exploded perspective view of the tablet cassette of FIG. 2 viewed from the lower side.
Figure 5:
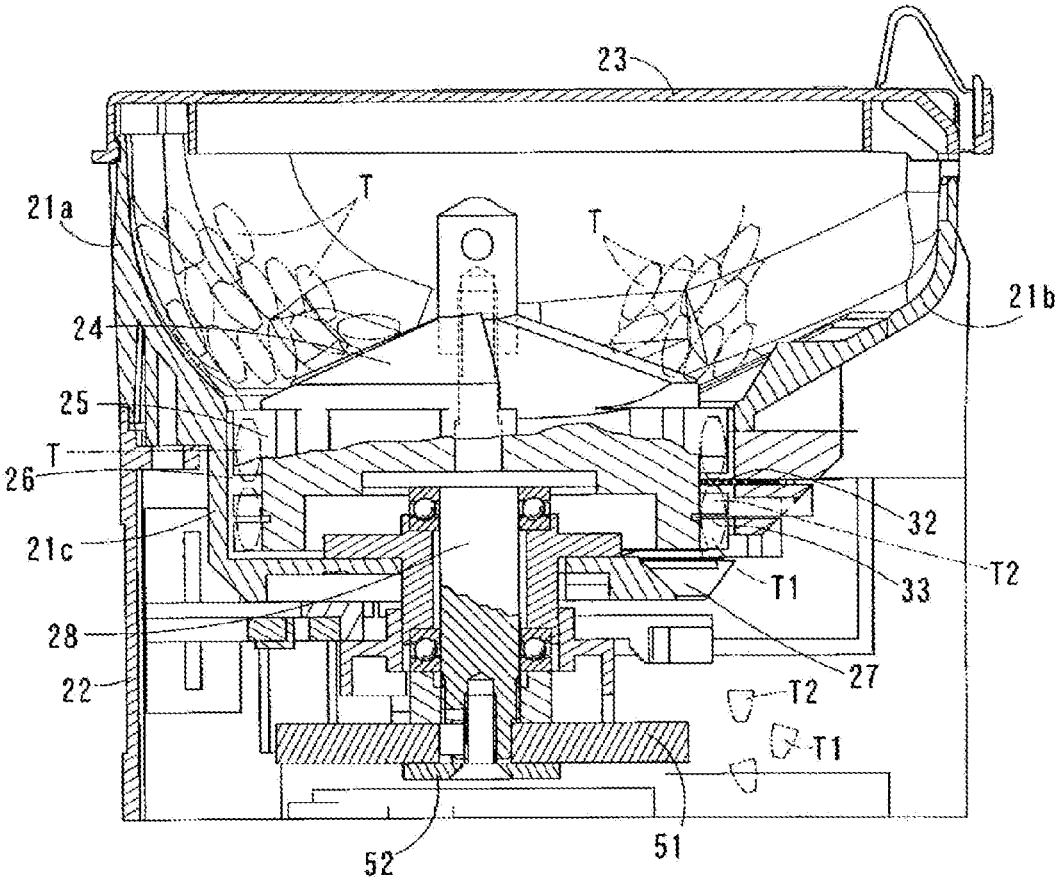
FIG. 5 is a side sectional view of the tablet cassette of FIG. 2.
Figure 6:
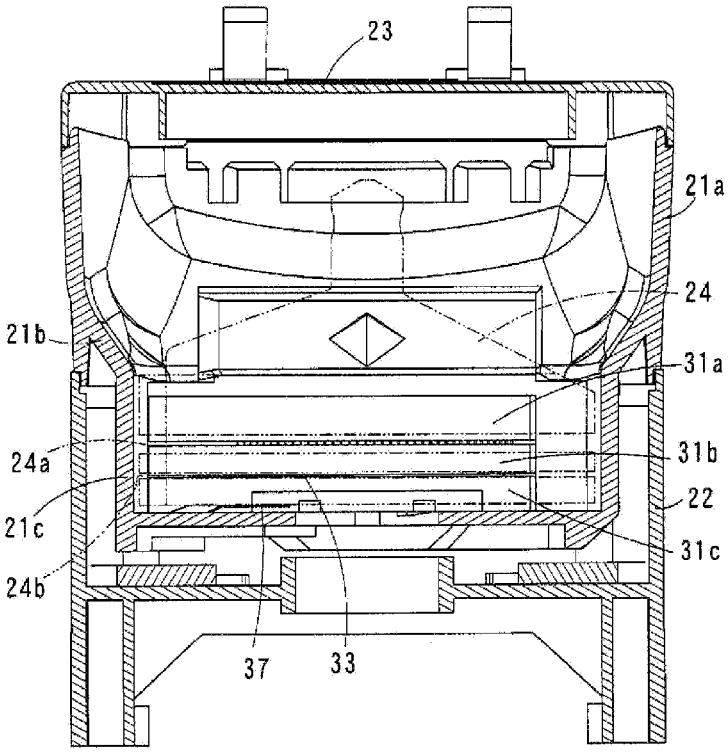
FIG. 6 is a rear sectional view of the tablet cassette of FIG. 2.
Figure 7:
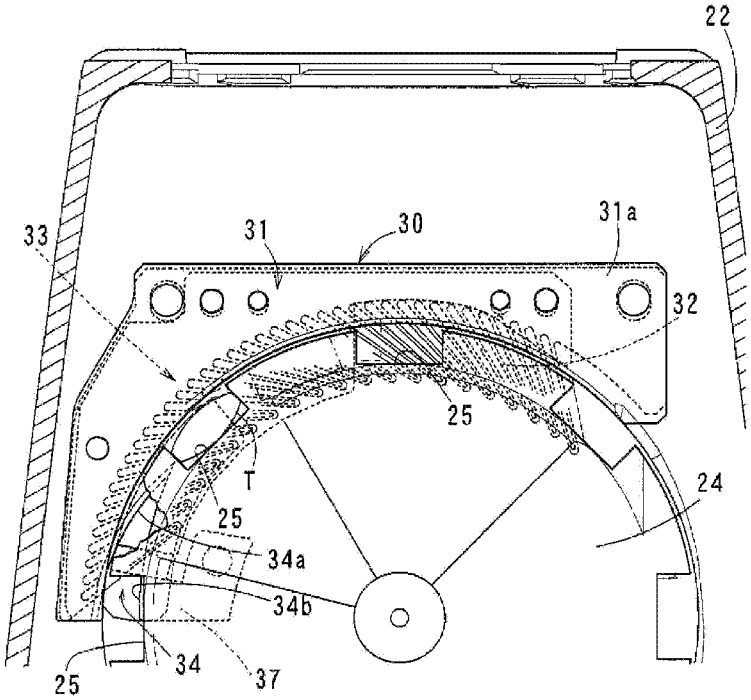
FIG. 7 is a top sectional view illustrating a portion of the tablet cassette of FIG. 2.

As illustrated in FIGS. 2 to 4, the tablet cassette 20 includes a synthetic resin container (tablet accommodating case) 21 having a rectangular portion 21*a*, a conical portion 21*b*, and a bottomed cylindrical portion 21*c* sequentially from the top, and a synthetic resin support 22 integral with the container 21 and which is U-shaped when viewed from the top surface. A plurality of tablets T is accommodated within the container 21. A top opening of the rectangular portion 21*a* can be opened or closed by a cover body 23. A synthetic rotor 24 is installed within the cylindrical portion 21*c*.

A top surface of the rotor 24 is conical, and a plurality of (eight in the embodiment) pockets (receiving recesses) 25 extending axially are formed at a regular interval on an outer peripheral surface of the rotor 24. The pockets 25 have an arc-shaped cross-section having a width large enough to contain only one tablet T and convexly curved toward a bottom surface thereof when viewed from the top (see FIG. 3), and since the tablet T has a generally arc-shaped surface, a tablet T is inserted on the arc-shaped bottom surface 25*c* in a fitted manner and the tablets T in the container 21 can be stably overlapped and introduced one by one as the rotor 24 is rotated. Accordingly, a first passage 26 through which a tablet T passes is formed between each pocket 25 and an inner peripheral surface of the cylindrical portion 21*c* (see FIG. 5), and eight first passages 26 are formed in the embodiment of the present invention. A discharge opening 27 is formed at a lower portion of the container 21 (a bottom plate of the cylindrical 21*c*) (see FIG. 5). The discharge opening 27 has a size larger than two times of a width of one pocket 25 of the rotor 24 (see FIG. 19).

Upper and lower circumferential grooves 24*a* and 24*b* into which a partition member 32 and the fixed blade 33, which will be described later, are inserted are formed on the entire outer circumferential surface of the rotor 24 (see FIG. 4).

Figure 8:
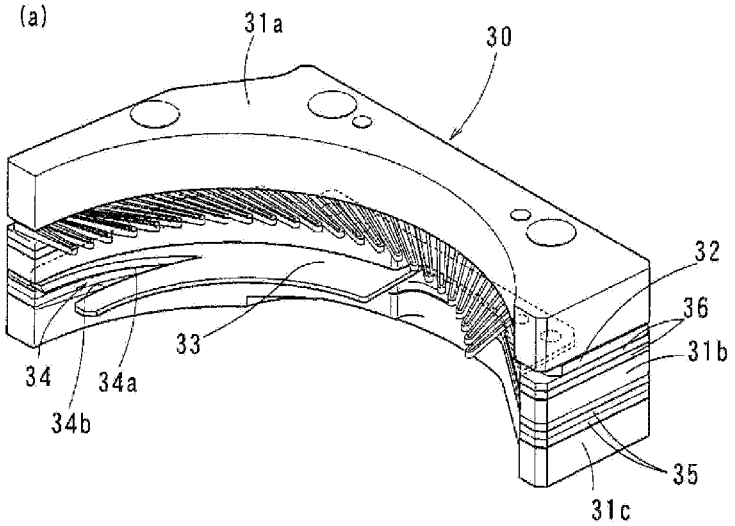
FIGS. 8A and 8B are perspective views illustrating main parts of the tablet feeder according to the embodiment of the present invention.
Figure 8:
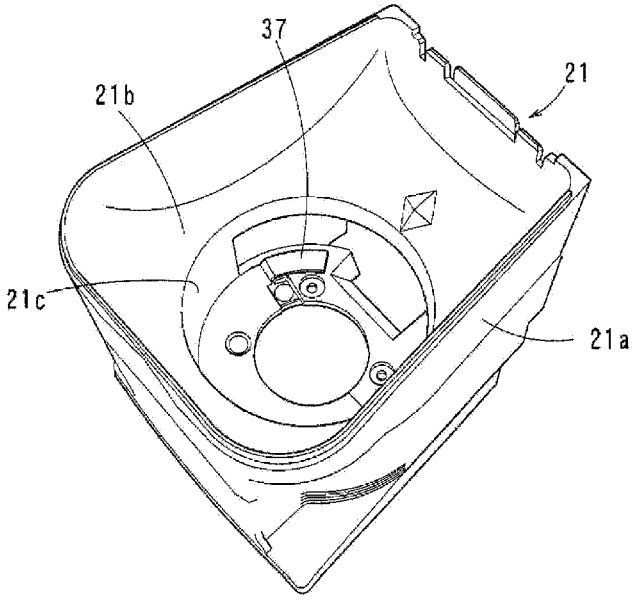
Figure 9:
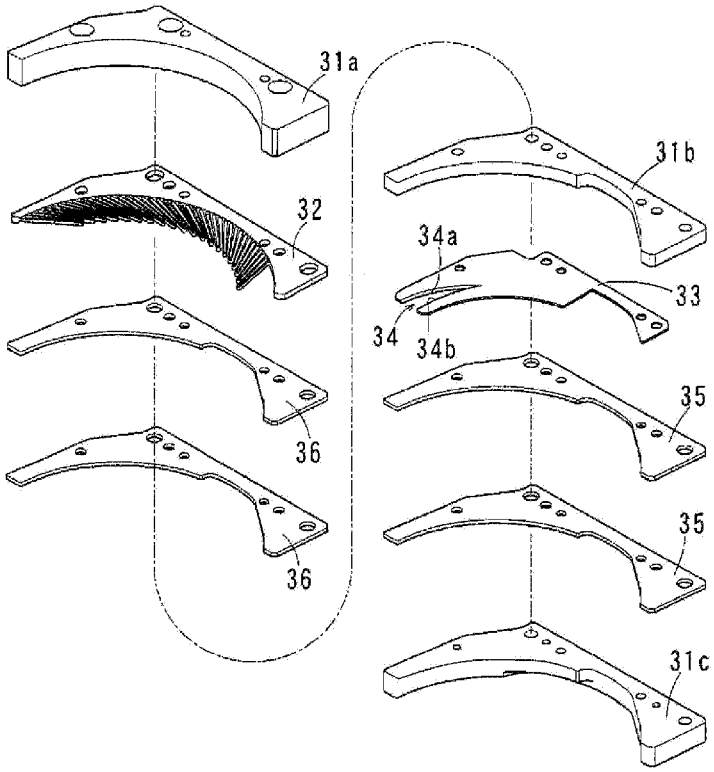
FIG. 9 is an exploded perspective view illustrating main parts of a tablet dividing mechanism.

A tablet dividing mechanism 30 is installed at an upper side (a side surface of the cylindrical portion 21*c*) of the discharge opening 27 of the container 21 of the tablet cassette 20 (see FIGS. 3 and 8). As illustrated in FIGS. 8 and 9, the tablet dividing mechanism 30 includes an attached block 31 where three flat plate pieces 31*a*, 31*b*, and 31*c* are stacked, a partition member 32 including a brush chucked by the upper two flat plate pieces 31*a* and 31*b* of the block 31 to be fixed, a fixed blade 33 chucked by the lower two flat plate pieces 31*b* and 31*c* of the block 31, spacers 35 and 36 interposed between the fixed blade 33 and the lower flat plate piece 31*c*, and the partition member 32 and the middle flat plate pieces 31*b*, and a piece-like lower guide 37 having a spring piece fixed to an inner surface of the bottom of the bottomed cylindrical portion 21*c* by means of a screw (see FIG. 8B).

The number of the spacers 35 and 36 may be set properly, such that the fixed blade 33 is located at a vertical center of a tablet T whose vertical position is determined by the lower guide 37 within the pocket 25 so that the tablet T can be divided into two halves T1 and T2 accurately, and the partition member 32 is accurately located between the upper and lower tablets T within the pocket 25 to separate into the two halves T1 and T2. The positions of the fixed blade 33 and the partition member 32 are adjusted by means of the spacers 35 and 36 after the tablet dividing mechanism 30 (block 31) is separated from the cassette 20.

The partition member 32 has a shape of brush hair and is inserted into the upper circumferential groove 24*a* on a side surface of the rotor 24, and is inserted into the pocket 25 facing the discharge opening 27 to divide the pocket 25 into upper and lower sides as the rotor 24 rotates to separate a tablet T located at the lowermost position of the pocket 25 from the upper tablet T (see FIGS. 19A and 19B).

As illustrated in FIGS. 8A and 9, the fixed blade 33 has a notch 34 whose width becomes gradually narrower from a periphery (a left end periphery in FIG. 8A) thereof facing the tablet T toward a moving direction (a right direction in FIG. 8A) of the tablet, and the facing peripheries of the notch 34 become arc-shaped blade tips 34*a* and 34*b* and the tip ends of the blade tips which become narrower coincide with each other (are merged to join together). The opening angles (opened angles of the notch 34), lengths, and arcing degrees of the two blade tips 33*a* and 33*b* are properly determined, considering the moving locus and size of the tablet T.

The fixed blade 33 enters the lower circumferential groove 24*b* on a side surface of the rotor 24, and cuts a vertical center of the tablet T within the pocket 25 facing the discharge opening 27 as the rotor 24 rotates horizontally (see FIGS. 19A to 19C).

Figure 21:
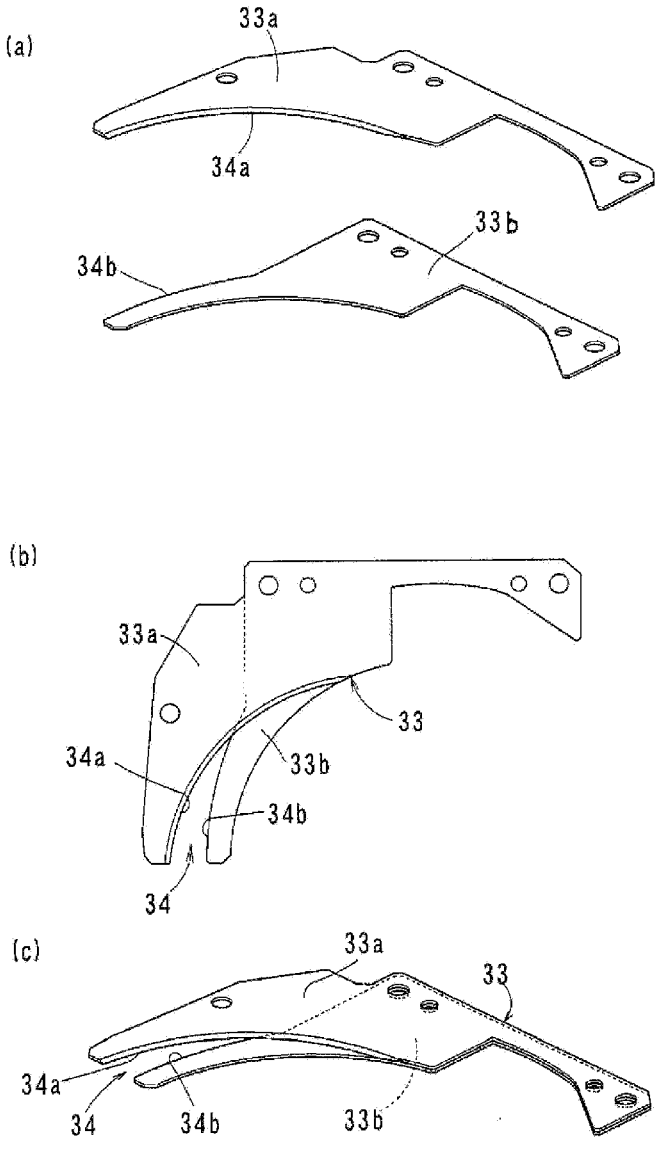

As illustrated in FIG. 21, the fixed (double-edged) blade 33 having two blade tips 34*a* and 34*b* may be obtained by overlapping two cutting blades 33*a* and 33*b*. That is, the fixed blade 33 includes the overlapping cutting blades 33*a* and 33*b*. In the two cutting blades 33*a* and 33*b*, a blade tip 34*a* is formed at a facing periphery of the cutting blade 33*a* by the blade tip of the cutting blade 33*a*, and a blade tip 34*b* is formed at a facing periphery of the cutting blade 33*b* by the blade tip of the cutting blade 33*b*, a notch 34 being formed between the two blade tips 34*a* and 34*b* when the overlapping state is viewed from the top.

The lower guide 37 contacts the tablet T within the pocket 25 which is to face the discharge opening 27, and gradually pushes the tablet T upward as the rotor 24 rotates and brings the tablet T into contact with the fixed blade 33. Then, the tablet sliding contact surface (top surface) of the lower guide 37 is horizontal, is inclined upward, and is horizontal again as illustrated in FIG. 8B. The fixed blade 33 (blade tips 34*a* and 34*b*) digs into a central portion of the tablet T in the former horizontal surface and the inclined surface of the lower guide 37 (see FIGS. 19A and 20A). Thereafter, the tablet T pushes and contacts the fixed blade 33 due to a pushing force of the lower guide 37 while moving on the latter horizontal surface and the lower guide 37 is deflected downward by a clearance into which the fixed blade 33 is inserted with respect to the tablet T to absorb the pushing force (see FIGS. 19A to 19B).

As illustrated in FIGS. 19A and 20A, the guided tablet T is cut by the fixed blade 33 as the rotor rotates 24, in which case one blade tip 34*a* gradually digs into the tablet T, and finally, the other blade tip 34*b* gradually digs into the tablet T so that the tablet T can be cut by the blade tips 34*a* and 34*b* (see FIGS. 20A to 20C).

As the rotor 24 rotates, the tablet T is divided into two halves, wherein the lower tablet piece T1 drops through the discharge opening 27 at the same time when it is divided and separated (see FIG. 19C), and the upper tablet piece T2 drops through the discharge opening 27 from a tip end of the fixed blade 33 also serving as a support piece during additional rotation of the rotor 24 (see FIG. 19D).

Then, the fixed blade 33 digs into a vertically central portion of the tablet T due to the resilience of the lower guide 37, maximally preventing the generation of fragments (pieces or cut powder b), and smoothly dividing the tablet T.

Figure 24:
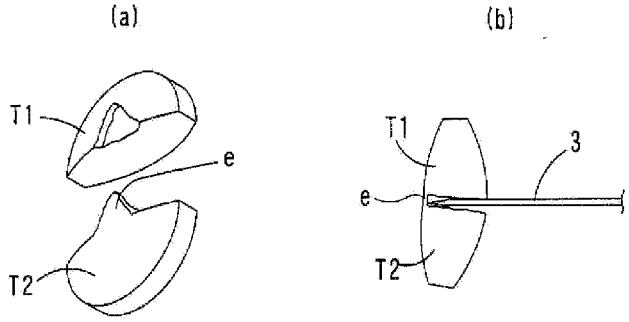
FIG. 24 is a view illustrating a conventional process of cutting a tablet.

Since the fixed blade 33 is necessarily interposed between the upper and lower tablet pieces T1 and T2 before they are cut and dropped (see FIGS. 20A to 20C), even in the case of a sugarcoated tablet T whose surface is coated, the coated layer can be cut with certainty, preventing easy generation of splinters e. Further, even when splinters e are generated, the splinters e are cut off at a converging point of the two blade tips 34*a* and 34*b*. Due to this, as illustrated in FIG. 24, generation of splinters e is prevented, and connection of the divided tablet pieces T1 and T2 due to splinters e is prevented optimally.

In this way, as the rotor 24 rotates in one direction (the tablet T moves in one direction), the tablet T is divided with certainty and the upper and lower divided tablet pieces T1 and T2 are supplied with a time interval (a rotational difference of 22.5 degrees). Thus, when a dose for a patient contains a half tablet piece and the number of the half tablet pieces is nine, i.e. an odd number (for example, three day doses for three times (in the morning, during the day, and at night) a day, the rotor 24 is stopped with the upper tablet piece T2 being raised to a tip end of the fixed blade 33. Further, for example, when the number of doses for four days, twice a day (in the morning and during the day) is eight, i.e. an even number, the rotor 24 is stopped at a time point when the upper tablet piece T2 is supplied from a tip end of the fixed blade 33. When supplying of the odd number tablets is completed and the next half tablet piece is supplied, the upper tablet piece T2 may be supplied as the initial half tablet.

In the embodiment of the present invention, existence of tablet pieces T1 and T2 in the pocket 25 is determined using supply timings, and is determined by contrasting detection signals of the detection sensor 18 for detecting a tablet T (T1 and T2) passing through the passage 14 with supply timings. The supplying timings are set by a DIP switch.

Figure 10:
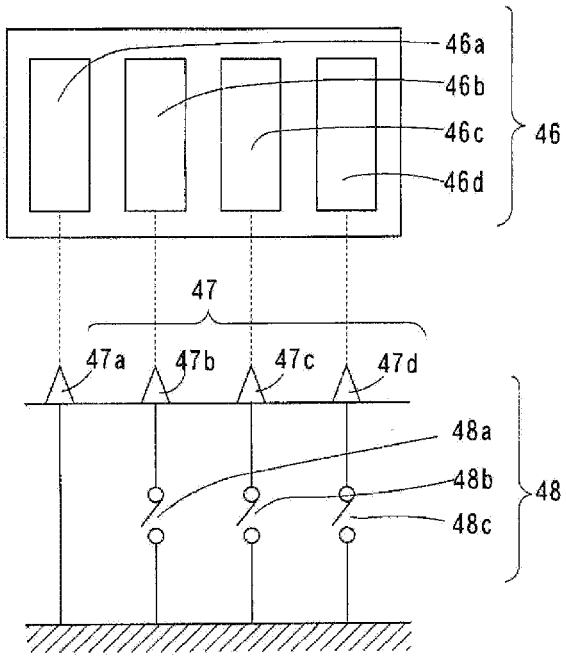
FIG. 10 is a tablet detection circuit diagram according to the embodiment of the present invention.
Figure 11A:
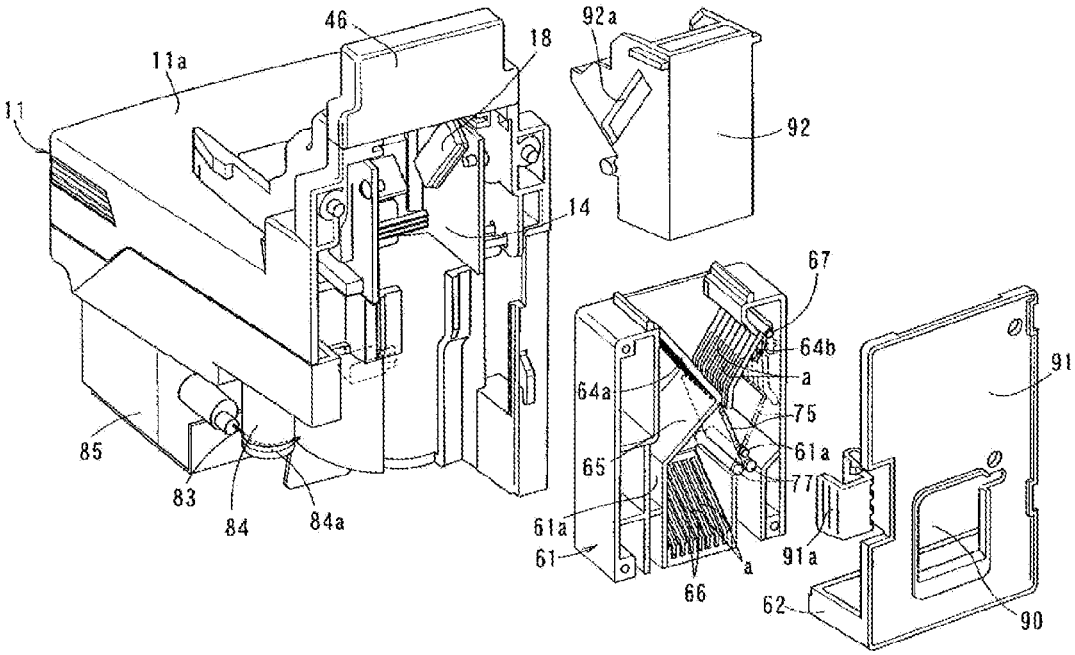
FIG. 11A is an exploded perspective view of a table cassette mount according to the embodiment of the present invention viewed from the rear side.
Figure 11B:
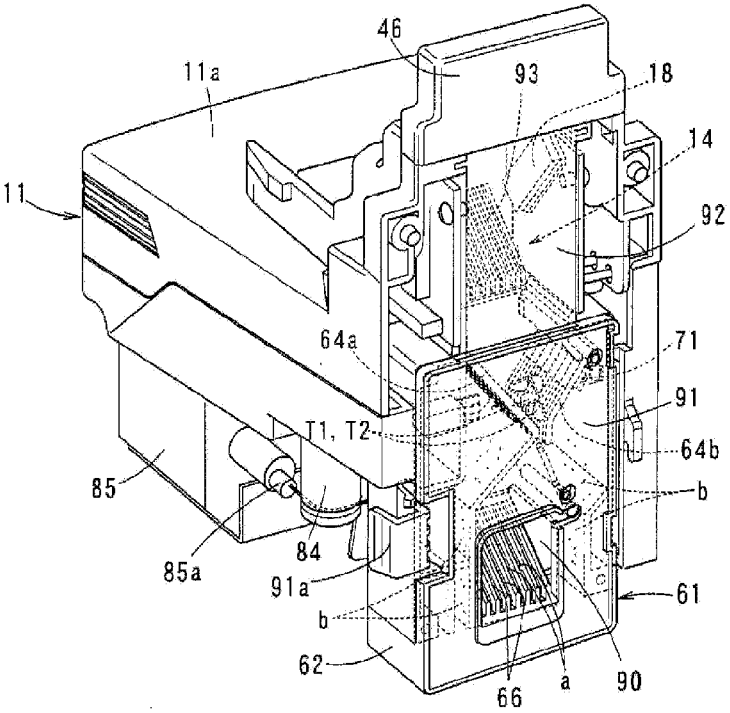
FIG. 11B is a perspective view of a table cassette mount according to the embodiment of the present invention viewed from the rear side.

The DIP switch is configured by installing flat contacts 46 (46*a*, 46*b*, 46*c*, and 46*d*) in the mount (motor base) 11, installing undulating contact points 47 (47*a*, 47*b*, 47*c*, and 47*d*) in the cassette 20, and installing switches (48*a*, 48*b* and 48*c*) which may be set to ON or OFF (a current flow state or a non-current flow state) in the contact points 47 of the cassette 20 between the circuits (see FIGS. 2 and 10).

The DIP switch may be set to eight states by properly setting the contact points 48*a*, 48*b*, and 48*c* of the switch 48 to ON and OFF states, and may be set according to the size and shape of the tablet T received in the cassette, and a timing (threshold value) according the setting (e.g. the size of the tablet T, etc.) is transferred (set) to a rotation controller of the rotor 24 (that is, the rotation controller reads the size of the tablet T in the cassette, etc.)

Accordingly, if the cassette 20 is set in the mount 11, a contact point 47 of the cassette contacts a contact point 46 of the mount so that they can be electrically connected to each other. Then, the contact points 48*a*, 48*b*, and 48*c* of the switch 48 are properly set to ON and OFF states according to the tablet T received in the cassette 20 and the set timing (threshold value) is transferred to the rotation controller of the rotor 24, whereby the rotor 24 is rotated by the timing so that the tablet pieces T1 and T2 can be supplied. In this way, the number of the tablet pieces T1 and T2 supplied according to the timing set based on the size of the tablet T, etc. is counted, and the supplying (dropping) of the piece b, for example, deviated from the timing is not counted (omitted).

The number of sizes, etc. (timings) of tablets T may be arbitrarily set by properly setting the number of the contact points 46 and 47. For reference, generally, when the tablets T received in the cassette 20 are of the same type (when the switch 48 is set to be the same), even if the cassette 20 is separated and set again, the record regarding the counted number of tablets or the existence of the tablets is not reset, and if the setting of the switch 48 is different, the record is reset when the cassette 20 is set again.

As illustrated in FIGS. 3 and 4, the rotary shaft 28 of the rotor 24 protrudes at a substantially central portion of a lower surface (bottom plate of the cylindrical portion 21*c*) of the bottom wall of the container 21, and a large gear 51 is fixed by a retaining ring 52 at a lower end thereof through a key 53. Thus, if the tablet cassette 20 is mounted to the mount 11, the large gear 51 is engaged with the pinion 13 and the rotor 24 is rotated by the motor through the engagement (engagement of the large gear 51 and the pinion 13).

As illustrated in FIGS. 11A to 18, a powder removing device (mechanism) is installed on a rear surface of the tablet dividing feeder A1. The powder removing device includes a case 61 attachable to and detachable from the mount 11, a cover 91 of the case 61, a powder removing plate installed in the case 61, and a powder receiving vessel (powder receiving box) 62 at a lower portion of the cover 91. The case 61 is inserted into the rear surface of the tablet dividing feeder A1 and then is fixed by a screw, etc. The cover 91 is attached to the case 61 by bringing the cover 91 into contact with a rear surface of the case 61 and inserting its knob 91*a* into the case 61. The cover 91 is separated from the case 61 by holding and deflecting the knob 91*a*.

A rectangular member 92 is formed at an upper portion of the tablet passage 14, a hole 92*a* through which the sensor 18 protrudes is formed in an inner surface of the rectangular member 92, and an inclined slit plate 93 which is not opened downward is installed at a lower inner surface thereof, whereby the tablet pieces T1 and T2 discharged (supplied) from the discharge opening 27 of the tablet dividing feeder A1 drop on the slit plate 93 and the tablet pieces T1 and T2 drop into the powder removing device (case 61).

The powder removing plates 64*a* and 64*b* in the case 61 include a pair of slit plates disposed to form an inverted triangle, and the lower ends thereof form an aperture t through which tablet pieces T1 and T2 cannot drop or contact each other. Accordingly, the tablet pieces T1 and T2 which have dropped from the tablet passage 14 are left between both the powder removing plates 64*a* and 64*b*. Then, one of the powder removing plates 64*a* may be a flat plate having no slit a. A dropping powder receiving plate 65 is installed at a lower end of the powder removing plate 64*a* and inclined downward and inversely, and a lower end of the dropping powder receiving plate 65 extends straight from the middle to the lower side to reach an upper surface of the powder receiving vessel 62. A powder removing plate 66 having a slip plate inclined from the front side to the lower rear side (the front side of FIG. 11A) is installed on the lower sides of the powder removing plates 64*a* and 64*b*, and a lower surface of the powder removing plate 66 faces an upper surface of the powder receiving vessel 62. The powder receiving vessel 62 is installed separately from the cover 91 and may be attached to and detached from the case 61.

Figure 12:
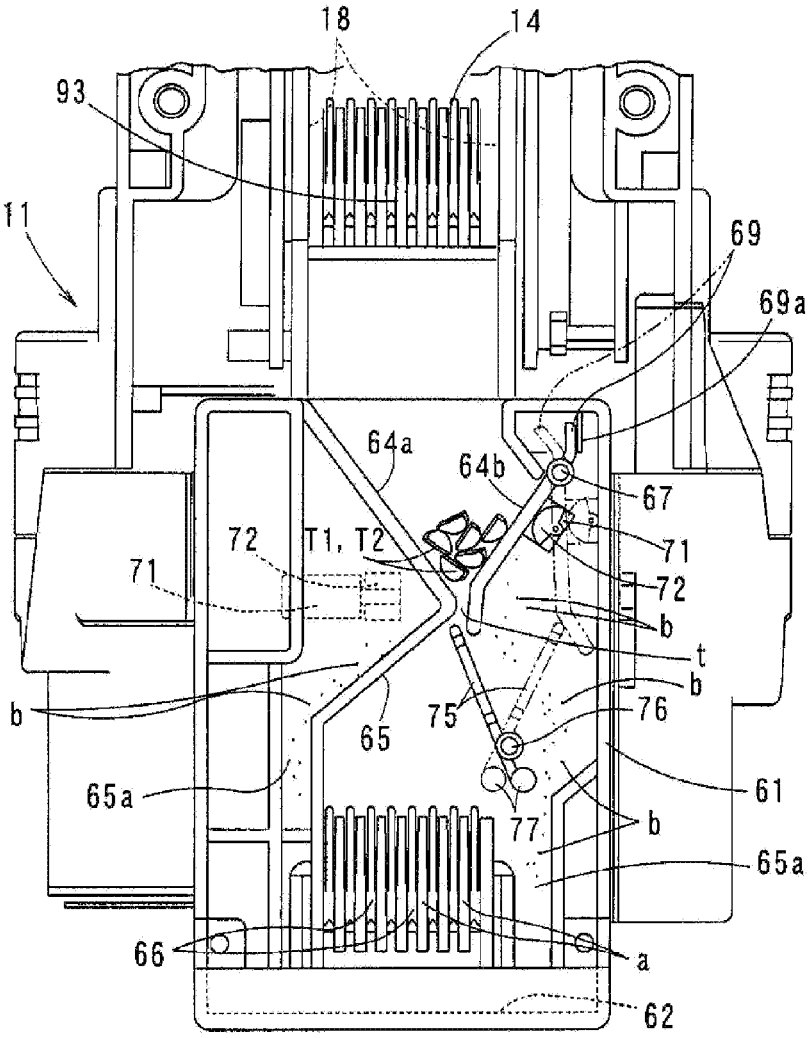
FIG. 12 is a rear view illustrating the tablet cassette mount with some portions of the tablet cassette mount being removed.
Figure 13:
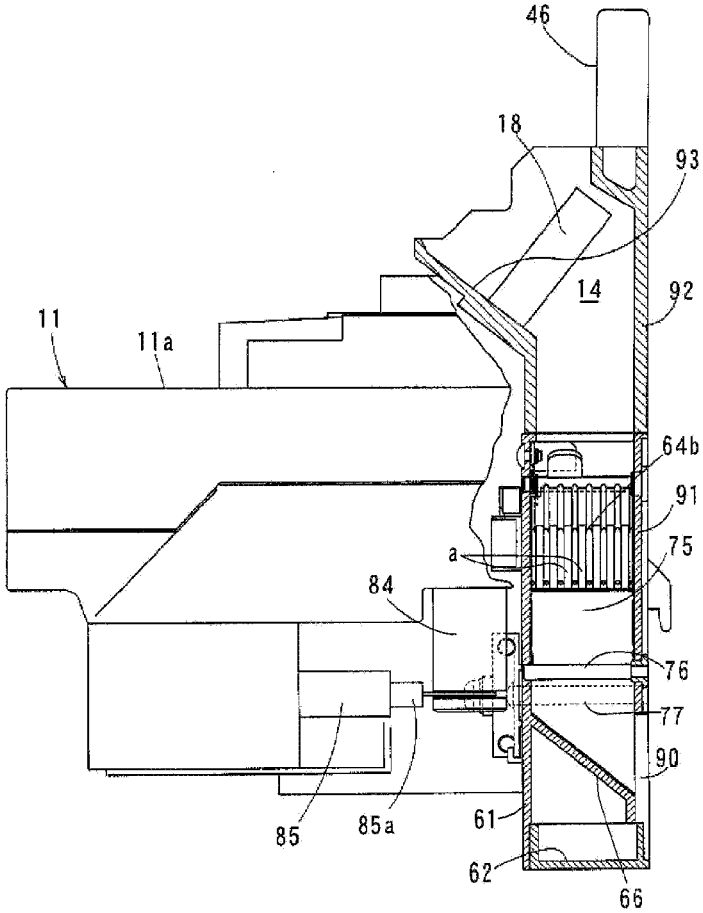
FIG. 13 is a side view illustrating the tablet cassette mount with some portions of the tablet cassette mount being removed.
Figure 16:
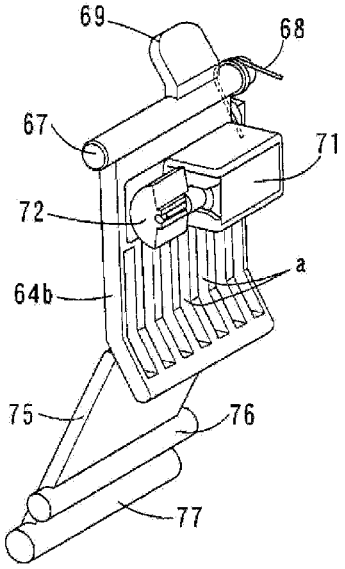
FIG. 16 is a partial perspective view of the tablet powder removing device.
Figure 17:
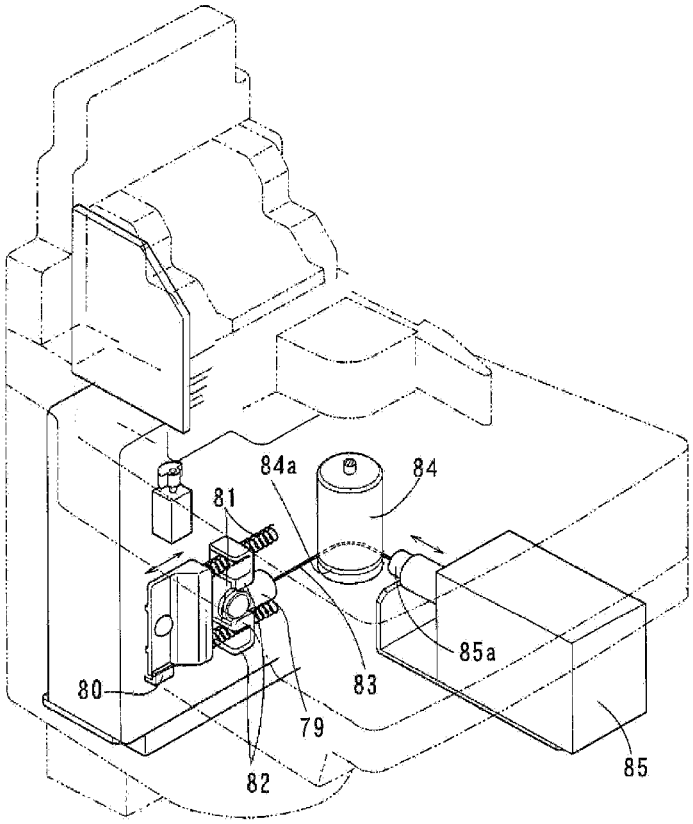
FIG. 17 is a partial perspective view of the tablet powder removing device.

One 64*b* of the other powder removing plates 64*a*, 64*b* are rotatably (swivellingly) installed at an upper end of the case 61 through a shaft 67, and a vibration motor 71 is installed on a rear surface thereof as illustrated in FIGS. 12 and 16. The vibration motor 71 has an eccentric piece 72 in the rotary shaft thereof, and is vibrated due to the eccentric piece 72 as it is rotated (driven). The powder removing plate 64*b* is also vibrated due to the vibration. The vibration motor 71 may be installed at one powder removing plate 64*a*, may be installed only one powder removing plate 64*a*, or may be installed in the case 61 as indicated by a dotted line of FIG. 12. The important thing is that the vibration motor 71 should be installed at a position where its vibration can remove the tablet powder most easily.

Figure 15:
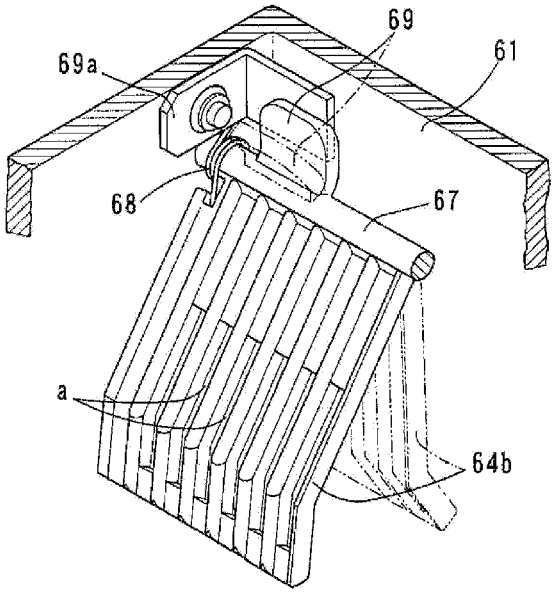
FIG. 15 is a partial perspective view of the tablet powder removing device.

A spring 68 is installed in the shaft 67 such that a low end of the powder removing plate 64*b* is pushed to face the powder removing plate 64*a* by the spring 68 and the stopper 69 contacts a sticking plate 69*a* on the inner surface of the case 61, securing an aperture (contact) t between the powder removing plates 64*a* and 64*b* (see FIGS. 12 and 15).

Figure 14:
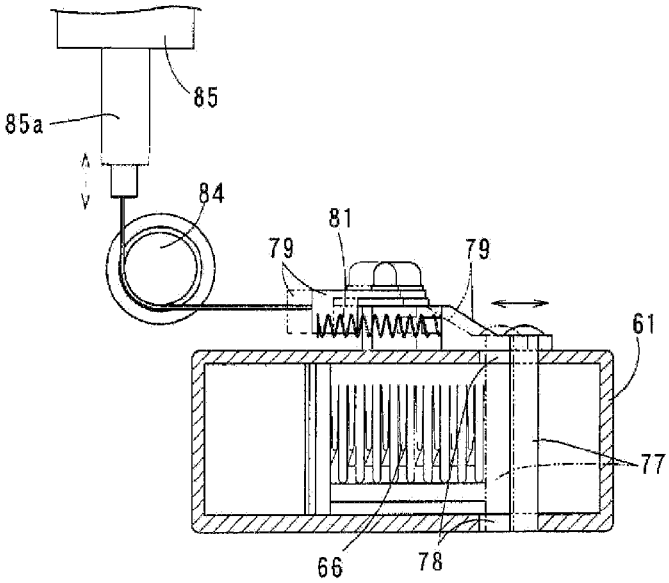
FIG. 14 is a plan view illustrating a table powder removing device installed in the cassette mount with some portions of the tablet powder removing device being cut away.

A rotary plate 75 whose upper end is located on a front surface of a lower end of the other powder removing plate 64*b* is rotatably (swivellingly) installed at the case 61 through a shaft 76 near the lower end thereof on the lower side of the other powder removing plate 64*b*. As illustrated in FIG. 14, the operating shaft 77 at a lower end of the rotary plate 75 is slidably inserted into a sliding hole 78 of the case 61. A slider 79 is fixed to one end of the operating shaft 77.

Figure 18:
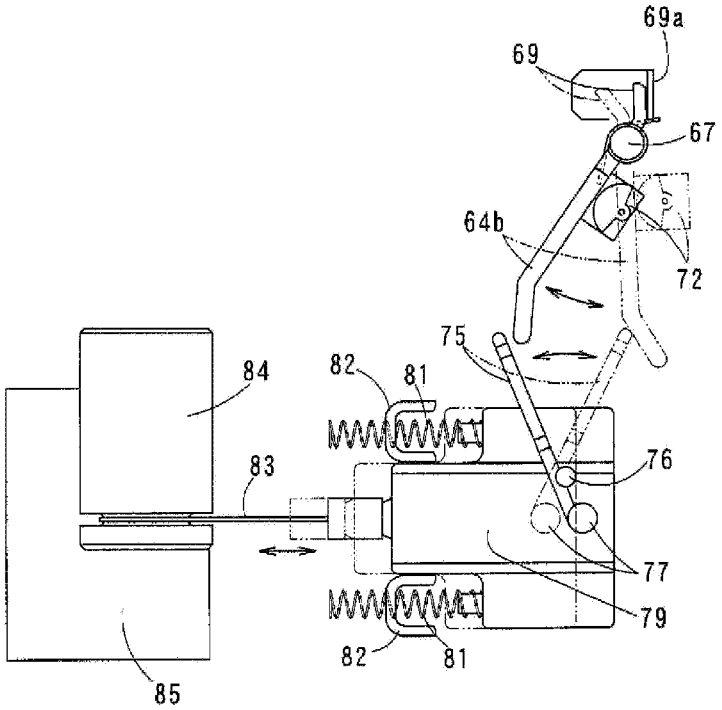
FIG. 18 is a plan view of main parts of the tablet powder removing device.
Figure 19:
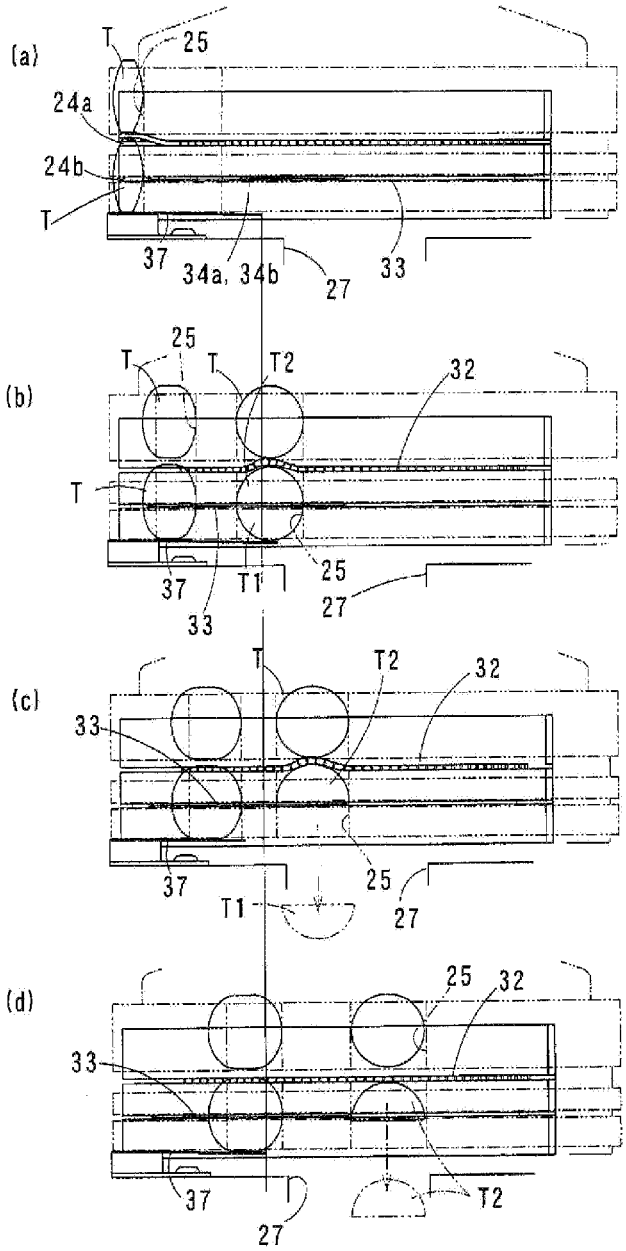
FIGS. 19A to 19D are schematic front views for explaining a process of dividing a tablet.
Figure 20:
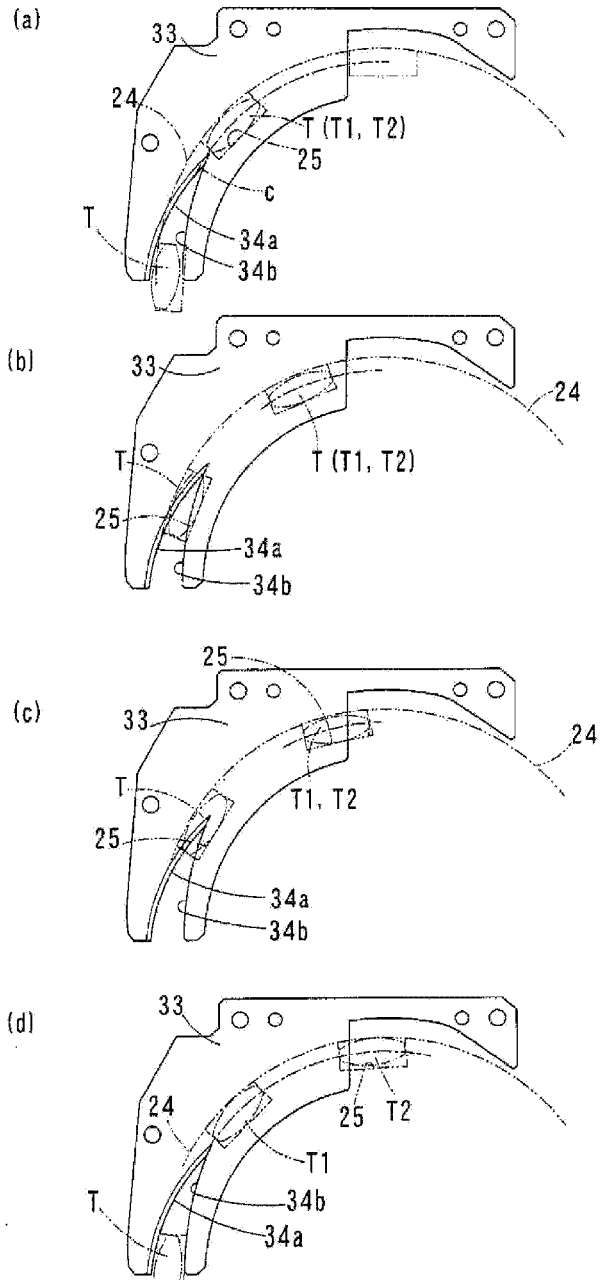
FIGS. 20A to 20D are schematic plan view for explaining a process of dividing a tablet.

As indicated by an arrow of FIG. 18, the slider 79 may be moved transversely by slidably guiding the guide 80 (see FIG. 17) and the operating shaft 77 in the sliding hole 78. The slider 79 is pushed by the coil spring 81 toward the right side of FIG. 18, and as indicated by a solid line of FIG. 18, contacts a lower end of the other powder removing plate 64*b* while being separated from or slightly contacting it due to the pushing operation. The spring 81 adjusts a pushing force depending on a degree by which it is inserted into a support member 82 in a screwing manner.

One end of a wire 83 is fixed to the slider 79, and an opposite end of the wire 83 is fixed to a plunger 85*a* of a solenoid actuator 85 through a rotary guide roller 84. As indicated by arrows of FIGS. 17 and 18, if the plunger 85*a* is withdrawn (suctioned), the slider 79 slides against the spring 81, whereby the rotary plate 75 fluctuates from the solid line to the dotted line (see FIGS. 12 and 18).

Then, an amount by which the slider 79 slides is determined depending on an amount by which the wire 83 of the plunger 85*a* is introduced. That is, an amount by which the rotary plate 75 fluctuates is determined. A guide groove 84*a* is formed in the rotary guide roller 84 such that the wire 83 cannot deviate. The rotary guide roller 84 may not be rotated.

The other powder removing plate 64*b* is also fluctuated by the fluctuation, whereby an aperture t between the powder removing plates 64*a* and 64*b* becomes larger so that the tablet pieces T1 and T2 between the powder removing plates 64*a* and 64*b* drop through the aperture t (the aperture t allows the tablet pieces to drop). Meanwhile, if the suctioned plunger 85*a* is released, the slider 79 is returned by the spring 81, and the rotary plate 75 and the other powder removing plate 64*b* fluctuate and return as indicated by a solid line of the drawing.

The configuration of the tablet dividing feeder A1 including the powder removing mechanism is as described above and the supplying operation thereof is also as mentioned above. At the time of supplying the tablets, if supply information is input to the tablet dividing feeder A1, the rotor 24 is rotated by a necessary number of rotations, and a necessary number of half tablet pieces T1 and T2 are supplied from the discharge opening 27 to the tablet passage 14 through the dividing operation.

The rotor 24 is rotated by a rotary angle according to the number of tablet pieces T1 and T2 which will be supplied. For example, since eight receiving recesses 25 are formed around the rotor 24, when the rotor 24 is rotated once, a total number of sixteen tablet pieces (halves of a tablet) are supplied, and the rotor 24 is rotated by 315 (360*(14/16)) degrees in the case of fourteen halves. Then, in the embodiment of the present invention, the rotor 24 is continuously rotated to a rotary angle according to the number of supplied tablet pieces, but may be intermittently rotated by 22.5 degrees whenever a half of a tablet is supplied.

The tablet pieces T1 and T2 supplied from the rotor 24 drop between the powder removing plates 64*a* and 64*b* from the top of the tablet passage 14. Then, as the other powder removing plate 64*b* vibrates, the tablet pieces T1 and T2 fluctuate therebetween, whereby the powder (including fragments) b attached to the tablet pieces T1 and T2 is peeled and the powder b drops through the slit a between the powder removing plates 64*a* and 64*b*. The powder b passes through the dropping passages 65*a* on both sides, and drops and gathers in the powder collecting vessel 62. In this way, if cut powder (fragments) b gathers in the powder collecting vessel 62, it may be easily wasted by removing the cover 91. Then, the powder, which has passed by the other powder removing plate 64*b* and dropped, drops on the rotary plate 75 and is guided to the dropping passage 65*a* on the lower side.

The tablet pieces T1 and T2 dropping along the powder removing plates 64*a*, 64*b*, and 66 are supplied from a supply opening (a lower opening of the cover 91) 90 of the corresponding mechanism, are sent to a hopper H, and are guided from the hopper H to a packaging process E.

For reference, if the tablets T (tablet pieces T1 and T2) are supplied from the rotor 24 to the passage 14 and it is detected that the tablet T passes through the passage 14, the tablet feeder A (tablet dividing feeder A1) determines that the tablet T has passed through the passage 14 and stops the rotor. Then, when the tablet T passes through in the powder removing device within the case 61 and reaches a packaging section E, for example, if the tablet T is detected by a sensor in the supply opening 90 or a passage extending from the supply opening 90 to the packaging section, the following tablet supplying operation is performed using the signal of the sensor.

Figure 22:
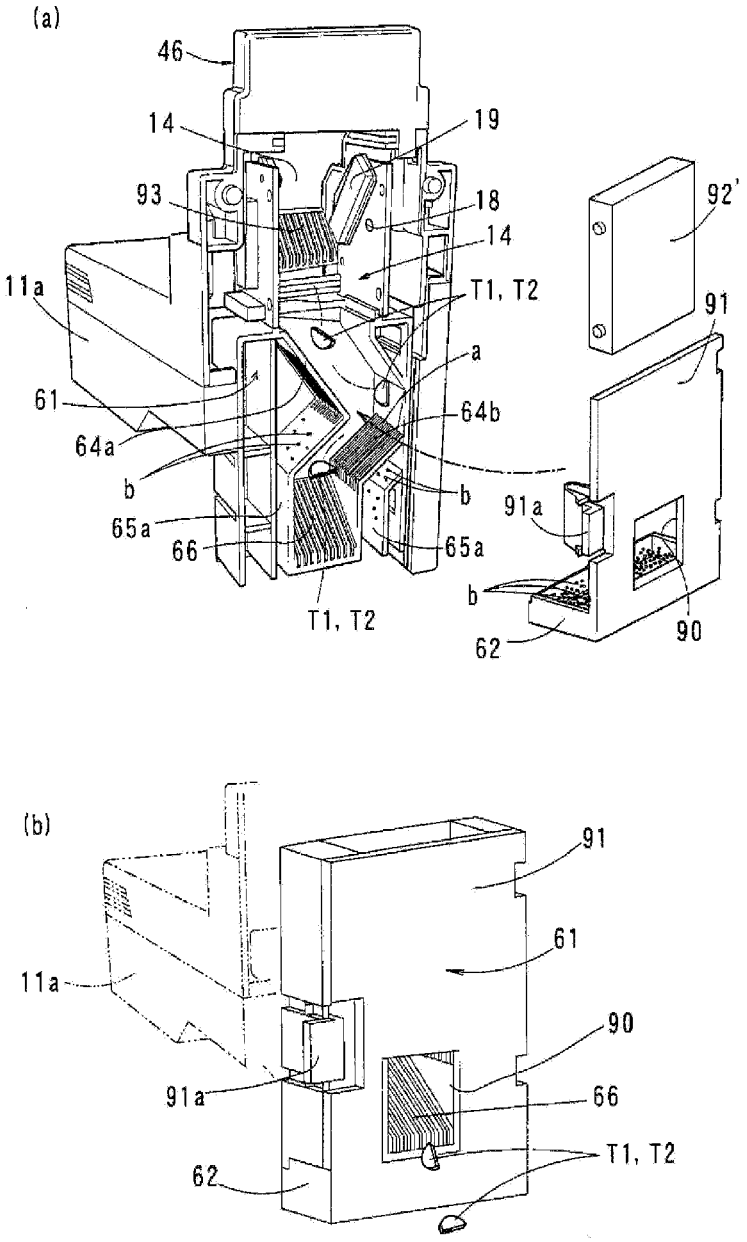

As illustrated in FIG. 22, the powder removing device according to the embodiment of the present invention may not employ the vibration motor 71.

That is, as illustrated in FIG. 22, the powder removing plates 64*a*, 64*b*, and 66 are installed to be inclined downward and cross the tablet passage 14. In the embodiment of the present invention, a rear surface of the tablet passage 14 is closed by a cover plate 92' without constructing an upper portion of the tablet passage 14 with the rectangular member 92. It is apparent that the rectangular member 92 may be employed, or the upper structure of the table passage 14 illustrated in FIG. 22 may be employed even in the embodiment of FIGS. 11A and 11B. In the two embodiments of the present invention, the powder removing plate may be fixed or detachable.

In the embodiment of the present invention, as illustrated in the drawings, since the powder removing plates 64*a*, 64*b*, and 66 are disposed in zigzags in four directions toward the lower side, the removal path of the cut powder (fragments) b is formed long. The tablet pieces T1 and T2 drop along the powder removing plates 64*a*, 64*b*, and 66 and the cut powder b drops into the dropping passage 65*a* on a rear surface of the powder removing plate without mixing with the tablet pieces T1 and T2, and gathers in the collecting pocket (powder collecting vessel 62) at a lower portion of the cover 91.

For reference, when the powder removing plates 64*a*, 64*b*, and 66, or the case 61 and the cover 91 are separated, if a sensor for detecting the separation or the setting of them is installed, a function of disabling supply of tablets using a signal of the sensor as long as they remain separated may be added. By doing this, cut powder (fragments) b can be prevented from being spread out to the periphery of the device when an operator separates them to clean the device and forgets to set them again.

In the embodiments of the present invention, the fixed blade 33 may not have two blades but may have only one blade (for example, a blade 33*a* illustrated on the upper side of FIG. 21A). Further, not slits but a plurality of small holes may be formed in the powder removing plates 64*a*, 64*b*, and 66 (refer to a bottom plate of a container indicated by the reference numeral 80 in FIGS. 34 and 35 of Japanese Patent Application Publication No. 2010-504097). For example, any configuration may be allowed only if the tablets T, T1, and T2 cannot pass but only the tablet powder b can pass.

It should be noted that the powder removing device is not limited to the tablet dividing feeder A1 but may be installed in a tablet feeder A which does not cut and split a tablet T. It is also apparent that the powder removing device for the tablet feeder A and A1 is not limited to a medicine supplying apparatus where tablet feeders A and A1 are disposed in a tray shape as shown in FIG. 23, but may be applied to a tablet feeder in various types of medicine supplying apparatuses having a tablet feeder such as a medicine supplying apparatus where tablet feeders A and A1 disclosed in Japanese Patent Application Publication No. 2008-162609 are disposed in a tray shape.

In addition, the powder removing device is not limited to a table passage 14 connected to the discharge opening 27 of the tablet feeder A, A1. For example, powder b attached to a tablet can be removed by installing the powder removing device in all tablet passages including a tablet passage communicated with the hopper H from the tablet passage 14 or a tablet passage connected to a packaging process E from the hopper E.

Although exemplary embodiments of the present invention have been described for illustrative purposes, those skilled in the art will appreciate that various modifications, additions and substitutions are possible, without departing from the scope and spirit of the invention as disclosed in the accompanying claims.

The invention claimed is:

1. A powder removing device coupled with a tablet feeder having a discharge opening, comprising:

a supply opening;

a tablet passage between the discharge opening and the supply opening; and at least one powder removing plate having pores or slits whose sizes do not allow a tablet configured to fit in the table feeder to pass therethrough and the at least one powder removing plate interposed to cross the tablet passage, wherein the tablet is configured to be discharged one by one through the discharge opening to reach the at least one powder removing plate, and to freely drop along the at least one powder removing plate to reach [[a]] the supply opening.

2. The powder removing device of claim 1, comprising:

at least one vibrator installed in the at least one powder removing plate; and at least one movement unit installed close to the at least one power removing plate, wherein the at least one vibrator is configured to close the tablet passage and cross the tablet passage downward and the at least one powder removing plate is movable to open the tablet passage from a closed state, and the movement unit is configured to change from a closed state to an opened state or from an opened state to a closed state of the tablet passage.

3. The powder removing device of claim 1, comprising:

at least one vibrator installed in the at least one powder removing plate, wherein a pair of powder removing plates closing the tablet passage and having pores or slits of a size which do not allow the tablets to pass therethrough are disposed to form an inverted triangle, lower ends of the powder removing plates have an aperture through which the tablet does not drop or contact a second tablet configured to fit in the table feeder, the at least one powder removing plate is movable to widen the aperture between a lower end of the at least one powder removing plates to allow the tablet to drop, and the at least one movement unit is installed close to the at least one moving powder removing plate.

4. The powder removing device of claim 2, wherein the vibrator installed is rotatably installed in a case of the at least one powder removing device forming the tablet passage such that an aperture between lower ends of the powder removing plates is widened so that the tablet drop by rotating the at least one powder removing plate by using the movement unit.

5. The powder removing device of claim 4, wherein vibrator installed is rotatable at an upper end thereof and be inclined to the lower side with respect to the ate least one tablet passage, a rotary plate is installed in the case such that a direction in which the rotary plate whose upper end contacts a lower end of the at least one powder removing plate is inclined downward is opposite to a direction of the at least one powder removing plate so as to be lower side of the at least one powder removing plate, and the rotary plate is configured to rotate by a solenoid actuator whereby the rotary plate is moved from a closed state to an opened state or from an opened state to a closed state.

6. The powder removing device of claim 1, wherein the at least one powder removing plates are installed in zigzags toward the lower side of the tablet passage.

7. The powder removing device of claim 1, wherein the tablet feeder is configured to cut and divide a tablet to supply the divided tablet to the discharge opening.

* * * * *

UNITED STATES PATENT AND TRADEMARK OFFICE

CERTIFICATE OF CORRECTION

PATENT NO. : 8,678,197 B2
APPLICATION NO. : 13/203944
DATED : March 25, 2014
INVENTOR(S) : Naoki Koike et al.

It is certified that error appears in the above-identified patent and that said Letters Patent is hereby corrected as shown below:

In the Claims

Column 14 should read:
- Claim 3, line 60: "at least one ~~moving~~ powder removing plate"

Column 15 should read:
- Claim 5, line 3: "the [[ate]] at least one"

Signed and Sealed this
Fifteenth Day of July, 2014

Michelle K. Lee

Michelle K. Lee
*Deputy Director of the United States Patent and Trademark Office*